US005758818A

United States Patent [19]

Ewing, Jr.

[11] Patent Number: 5,758,818

[45] Date of Patent: Jun. 2, 1998

[54] DIVIDABLE MULTI-COMPARTMENT CONTAINER

[75] Inventor: Paul E. Ewing, Jr., Monroe, Conn.

[73] Assignee: Mott's Inc., Stamford, Conn.

[21] Appl. No.: 827,491

[22] Filed: Mar. 28, 1997

[51] Int. Cl.[6] ..... B65D 5/54

[52] U.S. Cl. ..... 229/120.011; 229/23 R; 229/120.24

[58] Field of Search ..... 229/117.02, 120.011, 229/120.24, 23 R

[56] References Cited

U.S. PATENT DOCUMENTS

| | | | |
|---|---|---|---|
| 2,404,067 | 7/1946 | Hill . | |
| 2,734,676 | 2/1956 | Lawrence | 229/23 R |
| 3,101,880 | 8/1963 | Peterson . | |
| 3,114,496 | 12/1963 | Wilcox . | |
| 3,163,351 | 12/1964 | Borgardt . | |
| 3,253,765 | 5/1966 | Train | 229/23 R |
| 3,365,109 | 1/1968 | Kessler et al. . | |
| 3,659,707 | 5/1972 | Nilsson et al. | 229/120.011 |
| 3,759,378 | 9/1973 | Werth . | |
| 3,993,191 | 11/1976 | Membrino | 206/386 |
| 4,533,052 | 8/1985 | Fruchey et al. . | |
| 4,793,494 | 12/1988 | Gordon, Jr. . | |
| 4,848,651 | 7/1989 | Hartness | 229/125.33 |
| 4,919,269 | 4/1990 | Wright et al. . | |
| 5,060,802 | 10/1991 | Johnson, Jr. et al. . | |
| 5,191,976 | 3/1993 | Stout et al. | 206/198 |
| 5,249,738 | 10/1993 | Werth | 229/235 |
| 5,299,733 | 4/1994 | Werth | 229/120.011 |
| 5,419,431 | 5/1995 | Neuber et al. | 206/256 |

FOREIGN PATENT DOCUMENTS

| | | | |
|---|---|---|---|
| 481695 | 4/1992 | European Pat. Off. | 229/120.011 |

*Primary Examiner*—Gary E. Elkins
*Attorney, Agent, or Firm*—Pennie & Edmonds LLP

[57] ABSTRACT

The present invention relates to a container which may be dividable into first and second segmented compartments. The dividable container includes a one piece body member, a cover member, and a base member. The body member defines the first and second compartments which each include an interior wall having a top edge and two side edges. A side wall, having first and second segments, extends from the side edges to form portions of two different sides of the container. The top edges of the interior walls are at least partially connected. The cover and base members include top and bottom portions, respectively, and a plurality of flaps for contacting and attaching to, respectively, the wall segments. The cover member, base member, and top edges of the interior walls may be severed along a plane located between the interior walls to form the segmented first and second compartments.

23 Claims, 9 Drawing Sheets

DIVIDABLE MULTI-COMPARTMENT CONTAINER

FIELD OF THE INVENTION

The present invention relates to a container used to ship a plurality of articles., such as beverage containers, to a site of use. More particularly, the present invention is directed to a container which may be divided into two or more separate containers, with each separate container continuing to maintain the plurality of articles intact therewithin.

BACKGROUND OF THE INVENTION

Large-scale merchandising has been followed by manufacturers of goods for many years in order to minimize time and to improve efficiency. It is generally efficient for a manufacturer, in the chain of distribution, to pack products into large boxes when shipping to a wholesaler or distributor. The distributor, who receives the large boxes, then must transfer the products to a retailer for ultimate sale to a consumer. Retailers and/or consumers have different needs. Thus, it is often desirable for retailers and/or consumers to purchase part of the contents of a large container, rather than the entire contents. This desire for a smaller number of articles may often be based upon limited storage capacity and/or cost, among other considerations. Thus, there has been a need in the retail and wholesale markets for providing efficient means for selling part of the contents of a container.

Manufacturers consider efficiency in a somewhat different sense than the retailer or ultimate consumer. Manufacturers are concerned about such factors as overall manufacturing cost, i.e., ease of construction, and whether existing equipment may be utilized in the production process. In particular, manufacturers prefer containers which may be constructed using simple dies, with little waste material, and with inexpensive materials. Retailers, consumers and distributors are also concerned about overall cost, as well as with ease of use. Further, retailers and distributors desire a product which may be easily separated without the risk of destruction or marring of the contents of the package. Retailers and distributors are also concerned about pilferage. Thus, a dividable container is needed which includes features which satisfies all of these requirements.

Several different multi-unit packaging systems have been developed for the marketing of divisible multi-unit containers. These containers have often been directed toward the marketing of beverage bottles or cans, as well as toward cigarettes and other products. Bottles or cans, such as the 12 oz. or the 16 oz. varieties, are often shipped in units of six, generally referred to as six-packs. Four six-packs generally make up a case. At present, four six-packs are often positioned together in a paper tray for shipment from the manufacturer to the distributor. Each individual bottle or can in the pack is typically held together by a piece of plastic having six circular openings, or by a simple wraparound package, either plastic or paper. The paper trays are discarded if the six-packs are to be sold individually. Thus, under current practices, bottles and cans, as described above, are often produced for either six-pack quantities or case quantities. When the six-pack quantities are desired, the tray is unnecessary. When the case quantities are desired, the plastic or paper wrapper is unnecessary. The same is true for twelve-packs, packages housing twelve individual cans or bottles. Twelve-packs are often wrapped in either paper or plastic. Two twelve-packs are shipped in case quantities in paper trays. Again, based upon the desired quantity, either the wrapper or the tray may be unnecessary.

To produce each of the above unit quantities, the manufacturer must establish a different manufacturing line. Further, all manufacturing, warehousing, transportation, storage, and delivery of containers must be separated. This results in unnecessary costs and losses in efficiency. Thus, it is desirable to provide a packaging system which avoids these extra costs and efficiency losses.

With regard to large beverage containing bottles, such as the 1 to 3 liter or the 1 to 2 quart variety, among others, large bottles are often shipped in quantities of 6 or 12 count per container. These containers are often conventional boxes with flap lids and intermediate dividers. The dividers help to keep the bottles from moving during transport. It is often desirable for the small retailer or the consumer, to purchase half-units, having a 3 or 6 count. This is particularly true of purchases made by consumers at wholesale buying clubs, where the provision of lower prices requires bulk purchases. Small store retailers also often prefer smaller quantities. Thus, it is desirable to provide a container which may be divided into smaller units. It is also desirable that both the original and the divided containers be pilfer-resistant and be sturdy enough to be handled in a warehouse-type environment.

Several different multi-compartment dividable packages have been devised. For instance, U.S. Pat. No. 3,101,880 to Peterson provides a container in the shape of a conventional box with a flap lid. A two-walled portion is glued into the center of the box to delineate two compartments and a slot is provided on each side of the box which aligns with the center of the partitions. Heavy broken lines are imprinted on the top and bottom of the box to guide the user to separate the two parts by cutting. This design requires the extra step of positioning and gluing a partition into the center of the carton. Further, unwanted waste material results from the die cutting of the carton blanks.

U.S. Pat. No. 4,793,494 to Gordon, Jr. discloses a break-apart container having a two-part design. An inner I-shaped member is positioned within an outer member, which wraps around the I-shaped member to form the bottom, sides, and tops of the container. The I-shaped member is glued together to form the dividing walls between the two inner compartments. The container may be divided by opening the top flaps and cutting through the bottom panel. The I-shaped inner member must also be cut apart. This design requires a relatively complex outer member blank and requires a complicated construction process since the outer member must be glued around the circumference of the inner I-shaped member.

U.S. Pat. No. 4,919,269 to Wright et al. discloses a multiple compartment container which may be separated into two units by removing a tear strip. The container is formed from a single sheet of material. The ends of a blank are folded inwardly to be glued to a central portion of the blank to define two parts. The flaps at either end are then glued together to close the container. The two parts are only held together by the single tear strip. This design requires a complicated blank, which adds to tooling costs, as well as a fairly complicated assembly process.

U.S. Pat. No. 5,249,738 to Werth discloses a detachable multi-unit package formed from a single blank. The blank is wrapped around the product and includes a central divided portion which is folded into a T-shape which is glued to the top after the bottles or cans are inserted. The units may be separated by cutting or using tear strips. This design requires a complicated blank, which requires high tooling costs, and a fairly complicated assembly process, which requires forming part of the blank into the central "T" shaped divider.

U.S. Pat. No. 5,419,431 to Neuber et al. discloses a separable container having two bottom portions and a top cover. Each bottom portion includes flaps on each side for connecting to the top portion. Two individual bottom portions are placed in side-by-side relation for receiving a plurality of articles in each portion. The top cover is adhesively attached to the flaps on each bottom portion to form the container. The container may be separated by cutting the two sides of the top portion. The blanks used for this design have some unwanted waste due to the provision of the flaps. However, the overall design is somewhat efficient and simple.

While all of the above-described designs are useful for their asserted purpose, it is continually desirable to improve upon and/or simplify the present designs for lower cost and higher efficiency. The present design accomplishes these goals by providing a dividable container which is die cut to form simple blanks, resulting in a minimal amount of waste material. A limited amount of adhesive is preferably used. The present container is easy to construct. Further, the invention incorporates a cover which may, in one embodiment, be removed and replaced. Other features of the present invention include its pilfer-resistance, high strength and stability, both before and after division, and neat appearance.

SUMMARY OF THE INVENTION

The present invention relates to a dividable container including a one piece body member, a cover member, and a base member. The body member defines first and second compartments having top and bottom openings. Each compartment includes an interior wall having a top edge and two side edges. A side wall extends from each side edge of the interior wall. Each side wall has first and second wall segments which are joined together and folded to form portions of two different sides of the container. The top edges of the interior walls are at least partially connected to each other.

The cover member is for enclosing the top openings of the compartments and is operatively associated with the first and second wall segments. The base member is for enclosing the bottom openings of the compartments and is operatively associated with first and second wall segments of the body member. The cover member, base member, and top edges of the interior walls can be severed along a plane located between the interior walls to form segmented first and second compartments.

The cover member may include a top portion and a plurality of flaps configured and dimensioned to contact the first and second wall segments of the body member. The cover member may include at least one discontinuity aligned with the plane located between the interior walls. The discontinuity may be an opening and/or a plurality of perforations. The opening may be elongated and may extend at least partly over the top edges of the interior walls. The perforations may be arranged in at least one line. The perforations may also be arranged to allow for removal of at least part of the top portion of the cover member.

The base member may include a bottom portion and at plurality of flaps, with the flaps attached to the first and second wall segments of the body member fore retaining items in the compartments. The base member may include at least one discontinuity aligned with the plane located between the interior walls. The discontinuity may be an opening. The opening may be elongated and may extend at least partly over the body member to expose the interior walls of the body member. The discontinuity may be a plurality of perforations and the perforations may be arranged in at least one line.

The first and second compartments of the container may be arranged in abutting relation. The second segments may extend from each interior wall and may abut each other to close each compartment. Alternatively, the second segments may be in non-abutting relation to provide a window for each compartment.

The base member flaps may not overlap each other. The cover member flaps may overlap each other. The base and cover members may be adhesively attached to the wall segments. The cover member may, advantageously, be removable from the body member when the cover member.

The connected portions of the top edges of the interior walls may include at least one perforation. Further, perforations or crease lines may be provided between the interior walls, the first wall segments, and the second wall segments to facilitate folding.

The interior walls of the body member may be substantially centrally located in the container to define substantially equally sized compartments. Further, a plurality of body members may be provided.

BRIEF DESCRIPTION OF THE INVENTION

Preferred features of the present invention are disclosed in the accompanying drawings, wherein similar references characters denote similar elements throughout the several views, and wherein.

Figure 1:
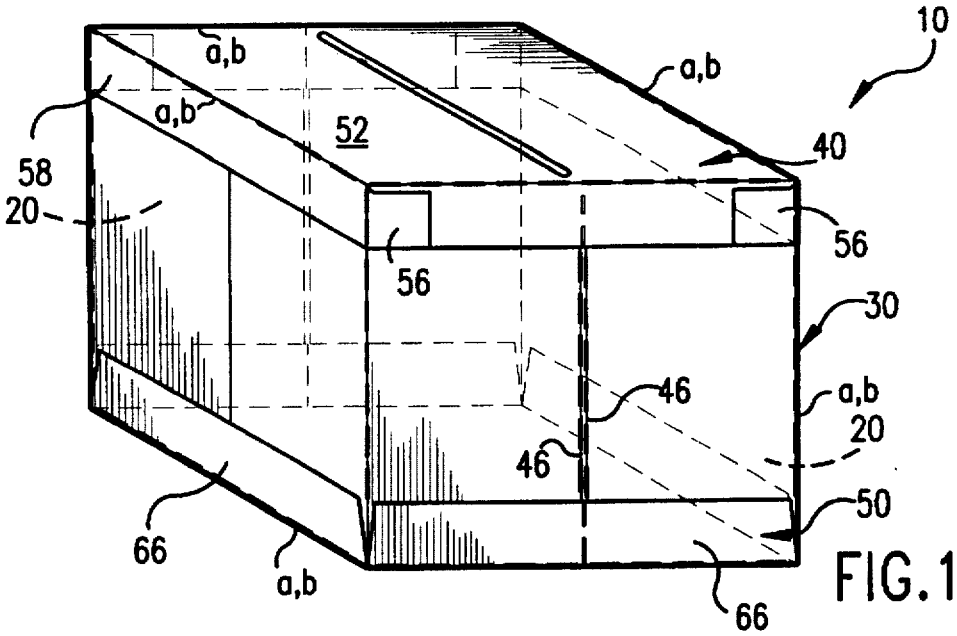
FIG. 1 shows a preferred embodiment of the dividable container of the present invention prior to being divided into two separate containers.
Figure 12:
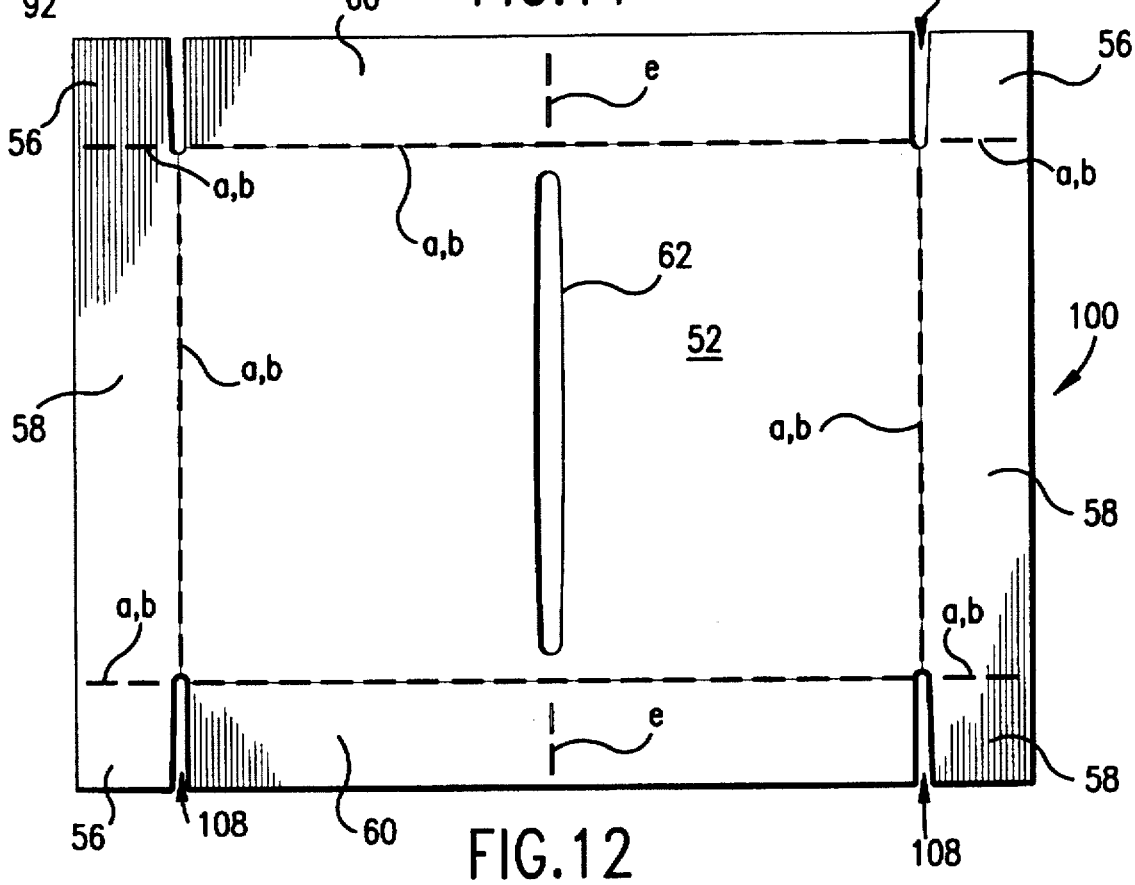
Figure 13:
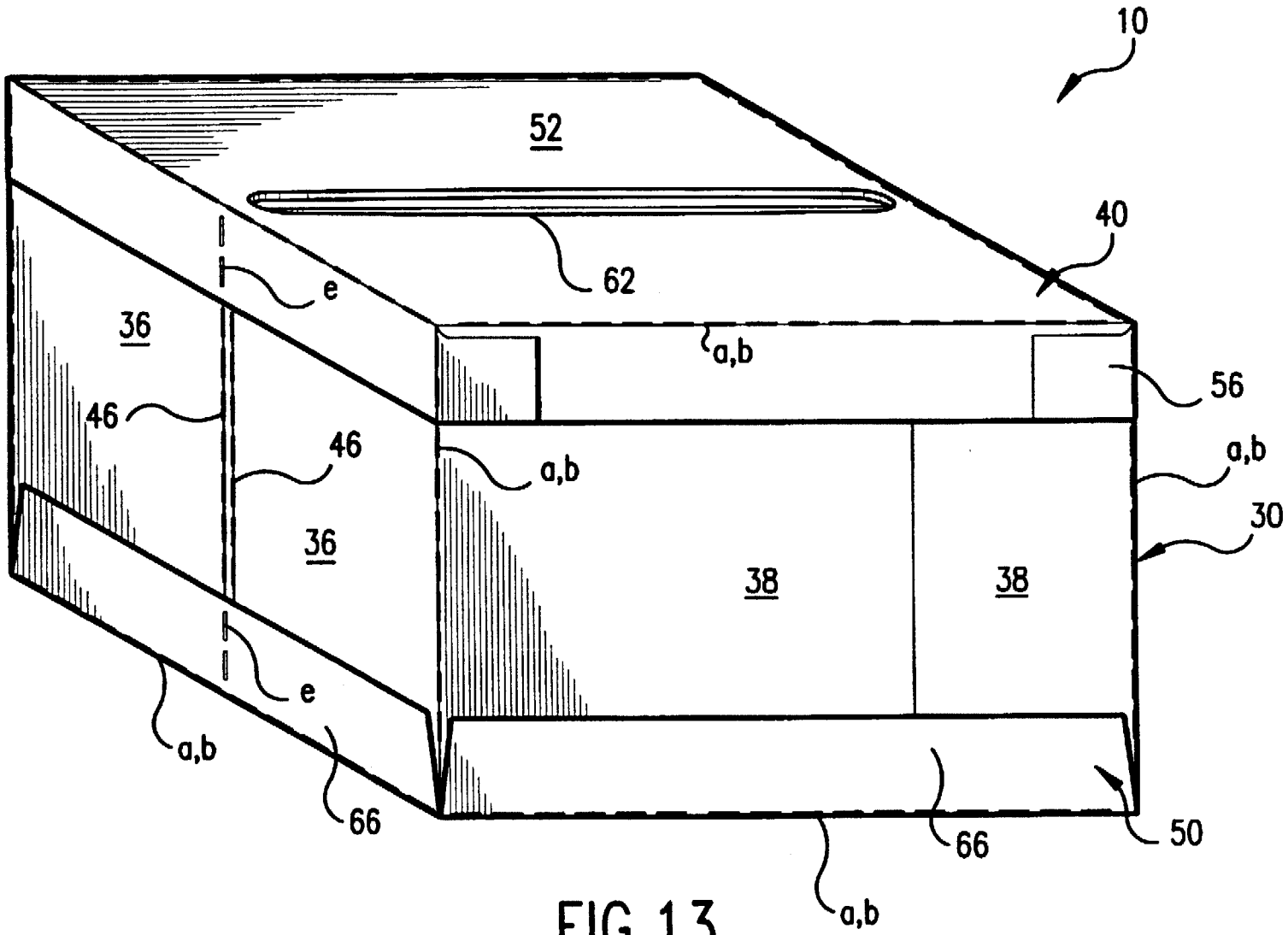
Figure 14:
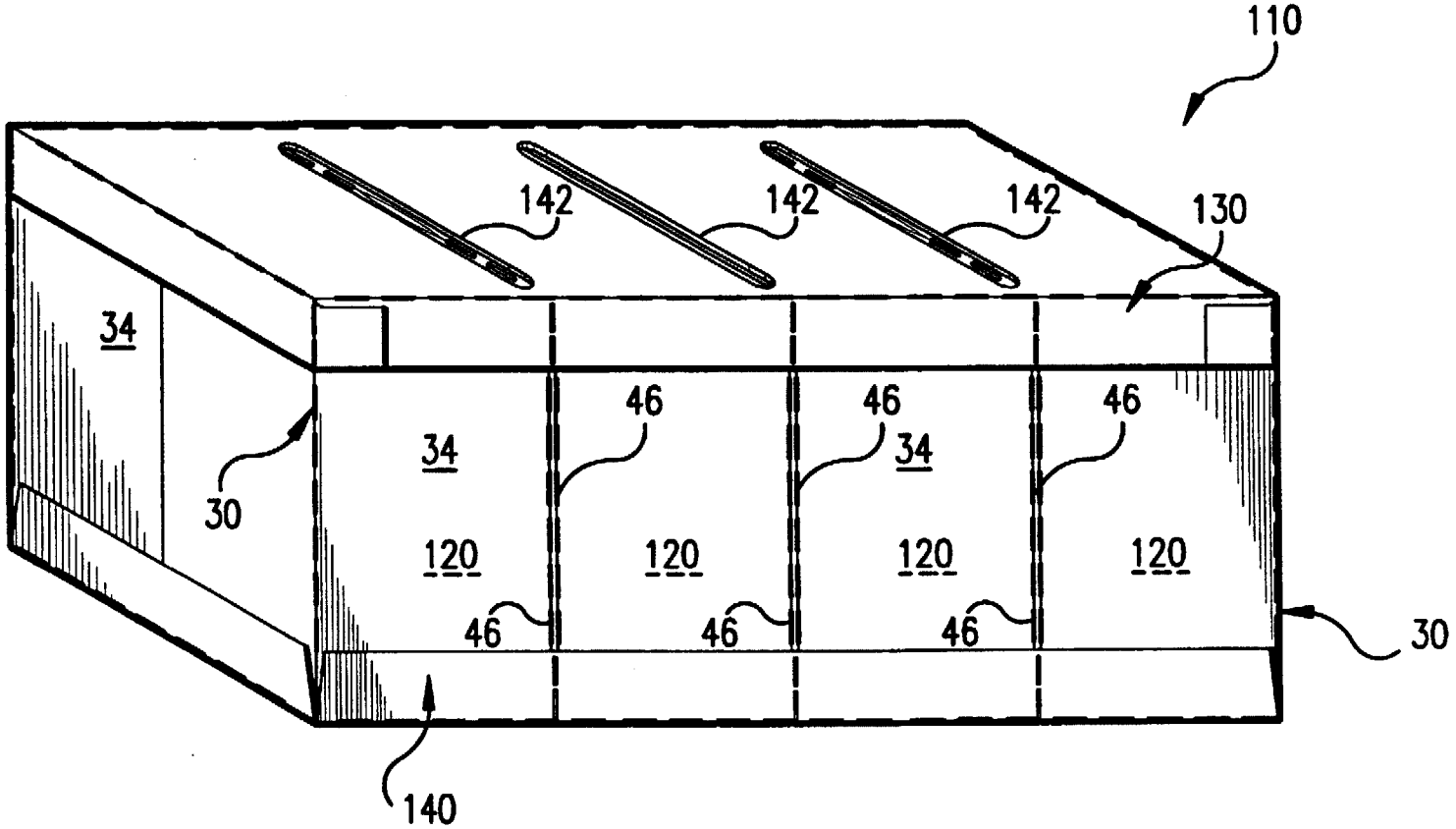

FIG. 12 is a plan view of a blank used to form the cover member of the container shown in FIG. 1 after the blank material has been die cut and further processed to form fold lines and lines of perforations, FIG. 13 is a alternative embodiment of the present invention dividable into two separate portions; and FIG. 14 is another alternative embodiment of the present invention dividable into four separate portions.

DETAILED DESCRIPTION OF THE INVENTION

Figure 2:
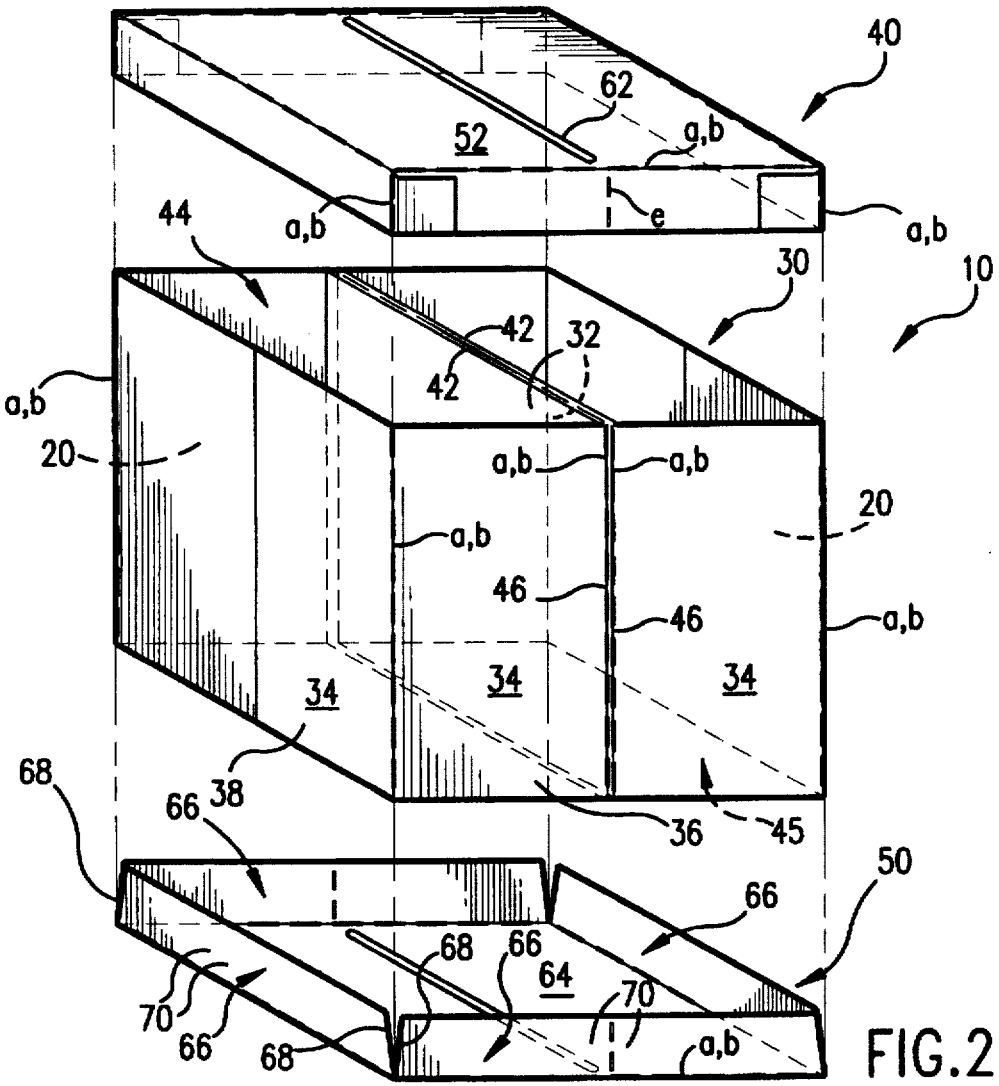
FIG. 2 is an exploded view of the container of FIG. 1.

Referring to the figures, the dividable container 10 of the present invention is shown fully constructed in FIG. 1 and in exploded view in FIG. 2. The dividable container 10 of the present invention preferably includes closed compartments 20 which are defined by a body member 30, a cover member 40, and a base member 50. When constructed the members form a container having multiple compartments 20 which can be separated by severing or cutting the body member 30, cover member 40, and base member 50. In a preferred embodiment, the container 10 includes first and second abutting compartments 20, as shown in FIGS. 1 and 2. This type of container would be well suited for small and large sub-containers and is particularly well suited for a twelve count of larger beverage bottles, with each compartment holding six bottles.

The body member 30 defines the body of the container 10. The cover member 40 serves as the lid or cover for the container while the base member 50 is preferably used to form the bottom of the container. Each member is preferably cut from a sheet of material and folded along crease lines and/or lines of perforations to form each individual member, as will be discussed in greater detail below. As used in this application, the words front and back are used to refer to a view of the body of the container along the length of the container The members 30, 40, 50 of the container 10 are preferably formed from a sheet of substantially rigid or semi-rigid, self supporting material; such as stiff paper, corrugated fiber board, or the like. Since the container of the present invention is envisioned to hold both small and large sub-containers, such as cans or bottles, the material utilized must be strong enough to withstand the weight of the product for shipment, e.g., stationary stacking of containers one upon the other, or for handling after shipment. Thus, the dividable container must be strong enough to perform suitably during both shipping and handling. Further; the containers may be used for display purposes. Thus, it is important that the containers be stackable upon each other. It is also a feature that the containers 10 be easy to open, providing quick access to the sub-containers.

As an example, a preferred material for use in constructing a 12 count container for holding 1 or 1.75 liter bottles is a corrugated fiber board material. The body member is preferably constructed from a 42-30-69 "C" Flute corrugate while the cover and base members are preferably constructed from 42-33-42 "B" Flute corrugate. These materials are selected due to their strength and durability characteristics. The body member, which stands on its side, is preferably formed from a material having high strength when positioned on its side, such as the "C" Flute material. In contrast, the cover and base members must be resistant to crushing. For this purpose, the "B" Flute material, which has a high resistance to crushing, is desirable. The materials for this embodiment are commercially available from International Paper of Geneva, New York.

Returning to the figures, as shown in FIGS. 1–9, the container, in a preferred embodiment, is rectangular in shape. The container depicted includes first and second abutting compartments 20. The body member 30 forms the four outer sides of the rectangle as well as the interior divider. The body member 30 is formed from a single blank (shown in FIG. 10) which is folded to define four outer walls and two interior walls 32. After the body member 30 is folded, the two compartments 20 define a top opening 44 and a bottom opening 45 and preferably remain joined along a top edge 42 of each interior wall 32. The top edges 42 are preferably located at the top opening 44 of he compartments 20. It should be noted, however, that the joined edge between the interior walls 32 may be located at either the top or the bottom of the container. It is preferable that the joined edge be located at the top to provide easy access for cutting.

The interior walls 32 include side edges 46 which are preferably substantially perpendicular to the top edges 42. A fold line a and a line of perforations b is preferably disposed along the side edges 46. Side walls 34 extend from the side edges 46 of each interior wall 32 to form the outer four walls of the assembled container 10. The side walls 34 each preferably include first 36 and second 38 wall segments. The first wall segments 36 are preferably connected to the interior walls 32 along the side edges 46 and the second wall segments 38 are preferably connected to the first wall segments 36 along fold or crease lines a. More preferably, a line of perforations b is provided, in addition to the fold lines a. Perforations are preferred because they make the heavy strength material of the blank more amenable to folding. Thus, it is evident that where weaker materials are used, it may be more cost effective to forego the use of perforations. Alternatively, perforations may be provided without fold lines. This applies to all fold lines a and perforation lines b depicted herein.

Figure 3:
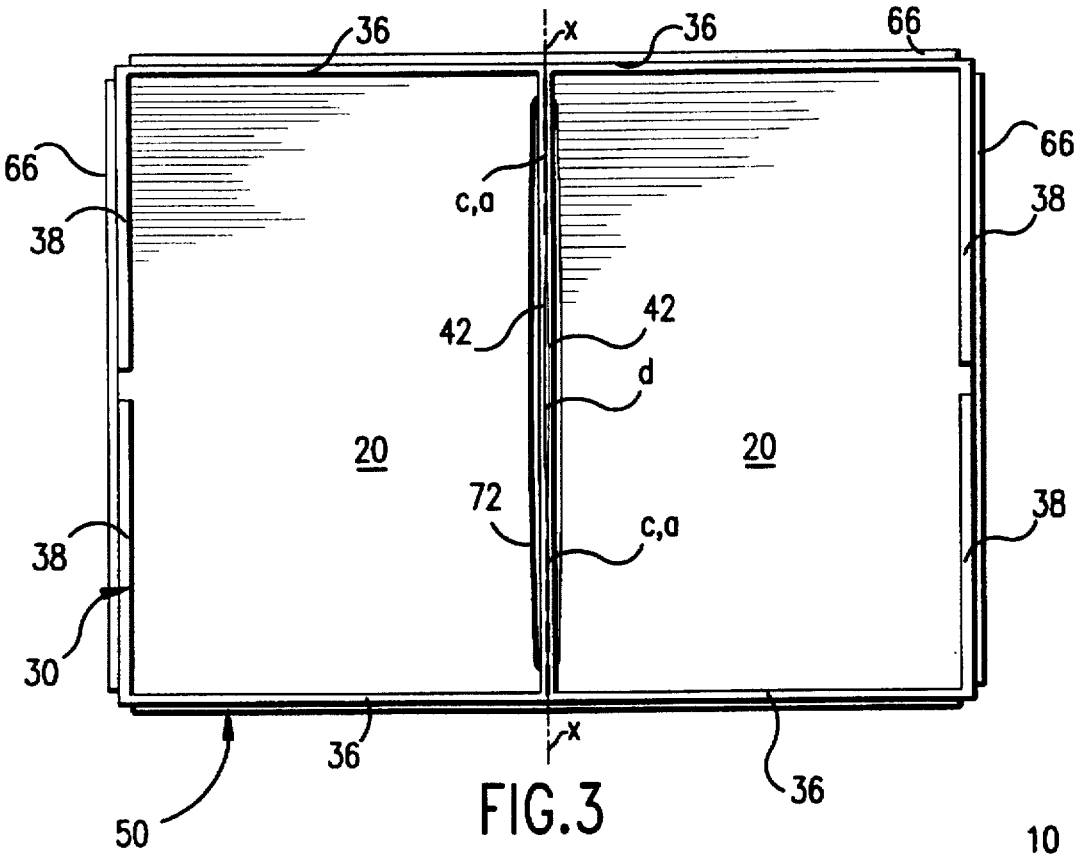
FIG. 3 is a top view of the container shown in FIG. 1 with the cover removed therefrom.

FIG. 3 shows the top opening 44 of the compartments 20 of the body member 30 when the member has been assembled. The interior walls 32 of the body member 30 preferably are joined in the center of the container 10 along the top edges 42 to define two individual equally sized compartments 20. The two interior walls 32 face each other after the body member 30 is folded at the top edges 42. The interior walls 32 are preferably only partially joined along the top edges 42. The joined area of the top edges 42 may include perforations and/or slits to aid in later separation and/or in folding. By providing an edge which is only partially joined, a minimal amount of cutting is required to sever between the top edges 42.

Figure 7:
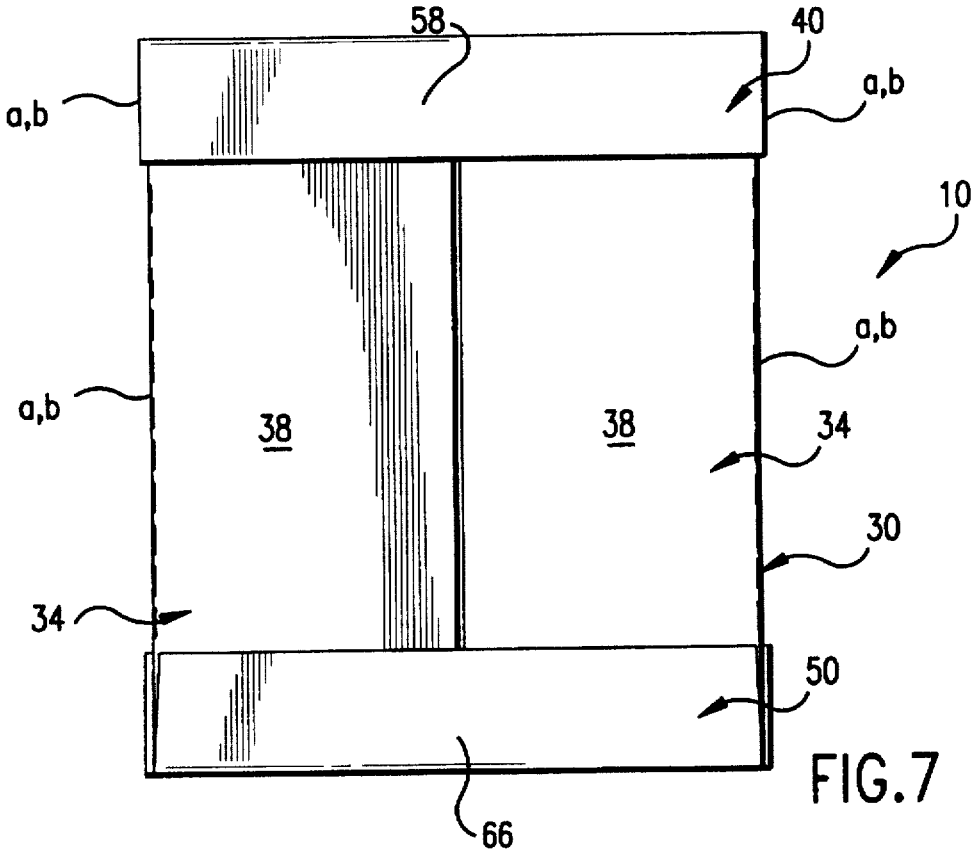
FIG. 7 is a side view of the container shown in FIG. 1.
Figure 8:
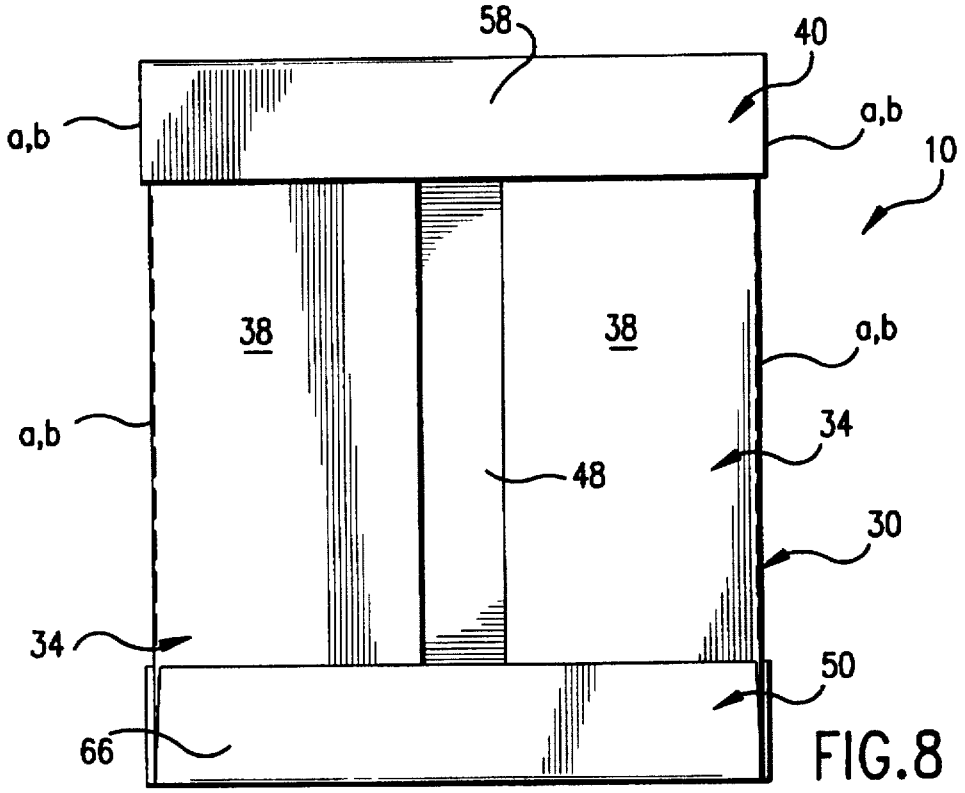
FIG. 8 is a side view of an alternative embodiment of the container shown in FIG. 1.

The side walls 34 are connected to the interior walls 32 and include first 36 and second 38 wall segments, as discussed above. As shown in FIGS. 3 and 7, the second segments 38 are folded around to complete each compartment 20 and may abut each other to close the container. Alternatively, as shown in FIG. 8, the second wall segments 38 may be in non-abutting relation, so as to form an opening or gap 48 along the sides of the container. This opening 48 can be used as a window for viewing the contents of the container 10. In addition, this alternative embodiment utilizes less material than the embodiment shown in FIG. 7, resulting in a potential savings in material cost. It should be realized that, depending upon the type of products stored in the container 10, the opening 48 between the side walls 34 should preferably be small enough to prevent pilferage and/or loss of the contents of the container 10 through the opening 48.

Returning to the top edges 42, as shown in FIG. 3, the joined portion of the top edges 42 preferably includes a plurality of perforations c and/or slits d. Advantageously, the joined portion of the top edges 42 also preferably is defined by a fold line a. Alternatively, the joined portion of the top edges 42 may be non-perforated along its length and/or non-slit along its length. If the joined portion of the top edges 42 are completely non-slit and non-perforated, the joined portion of the top edges 42 will be more difficult to sever than if the top edges 42 d include perforations c. If the top edges 42 include both slits and perforations, an additional advantage is found in that a blade or knife may be inserted between the interior walls 32 through one of the slit portions d and then may be slid between the walls 32 to separate the perforated portions c between the top edges 42. Inserting the knife between the interior walls 32 avoids the potential for the knife slipping into the compartments 20. It is preferred that the cutting member, whether knife, razor, scissors or the like, be deterred from entering the compartments 20 in order to avoid damage to the sub-containers. Thus, the top edges 42 preferably include slit portions d for allowing safe entry of the cutting edge between the interior walls 32 and safe severing of the top edges 42. Once the top edges 42 are separated along their length, the body member 30 is separated.

Referring again to FIGS. 1 and 2, the cover member 40 is preferably formed from a single sheet of material and forms the top of the container 10 to close the top opening 44 of the body member 30. The cover member 40 may serve as a removable lid or may be either permanently or temporarily attached to the body member 30.

The cover member 40 includes a top portion 52 which is preferably substantially the same size as the top openings 44 of the compartments 20. The cover member 40 also preferably includes flaps 58, 60. Fold or crease lines a and/or lines of perforations b are preferably formed along each outer edge of the top portion 52 and the flaps 58, 60 are connected to the top portion 52 along each line a, b. After assembly of the cover member 40, the flaps 58, 60 are preferably folded at a substantially about 90° angle relative to the plane defined by the top portion 52. Each flap 58, 60 is preferably folded in a common direction so that a substantially rectangular box-type shape having a height which is preferably substantially less than the height of the body member 30 is formed when the flaps 58, 60 are folded. The flaps 58, 60 form the sides of the assembled cover member 40. The top portion 52 forms the top of the cover member 40 and the bottom of the cover member 40 is open so that the cover member 40 can fit over the top openings 44 in the compartments 20.

In a preferred embodiment, the flaps 58, 60 include tabs 56 which extend along fold lines a and/or perforations b from the ends of the outer flaps 58 so that the outer flaps 58 may be folded upon the inner flaps 60 and attached thereto by any conventional means, such as by gluing with an adhesive, stapling, taping, or the like. The tabs 56 are preferably firmly secured to the adjacent inner flaps 60 so that the cover member 40 holds an open box-type shape.

The tabs 56 preferably extend at opposite ends of each outer flap 58. Each tab 56 is configured and dimensioned so that when it is folded along the fold lines a, the tabs 56 are sized to wrap around for securing to the adjacent inner flap 60. The tabs 56 are preferably sized to be substantially the same height as the adjacent inner flap 60 so that they overlap the entire height of the inner flap 60 for at least a short distance along the length of the inner flap 60. It is preferred that the tabs 56 substantially overlap the entire height of the adjacent inner flap 60. The tabs 56 add stability and strength to the cover member 40. Thus, a tab 56 having a greater height, which is substantially equal to the height of the adjacent inner flap 60 is preferred for added strength. Alternatively, if it is desired to have a cover member 40 which is easily dismantled after use into a flat sheet, it is evident that a tab 56 which is short in height may be more easily torn. A tab having perforations b along the fold line a where the tab 56 attaches to the outer flap 58 would also assist in making the cover member 40 more amenable to breaking down. Thus, the tabs 56 should be configured and dimensioned considering the necessary strength and handling characteristics as well as the after-use requirements.

Figure 4:
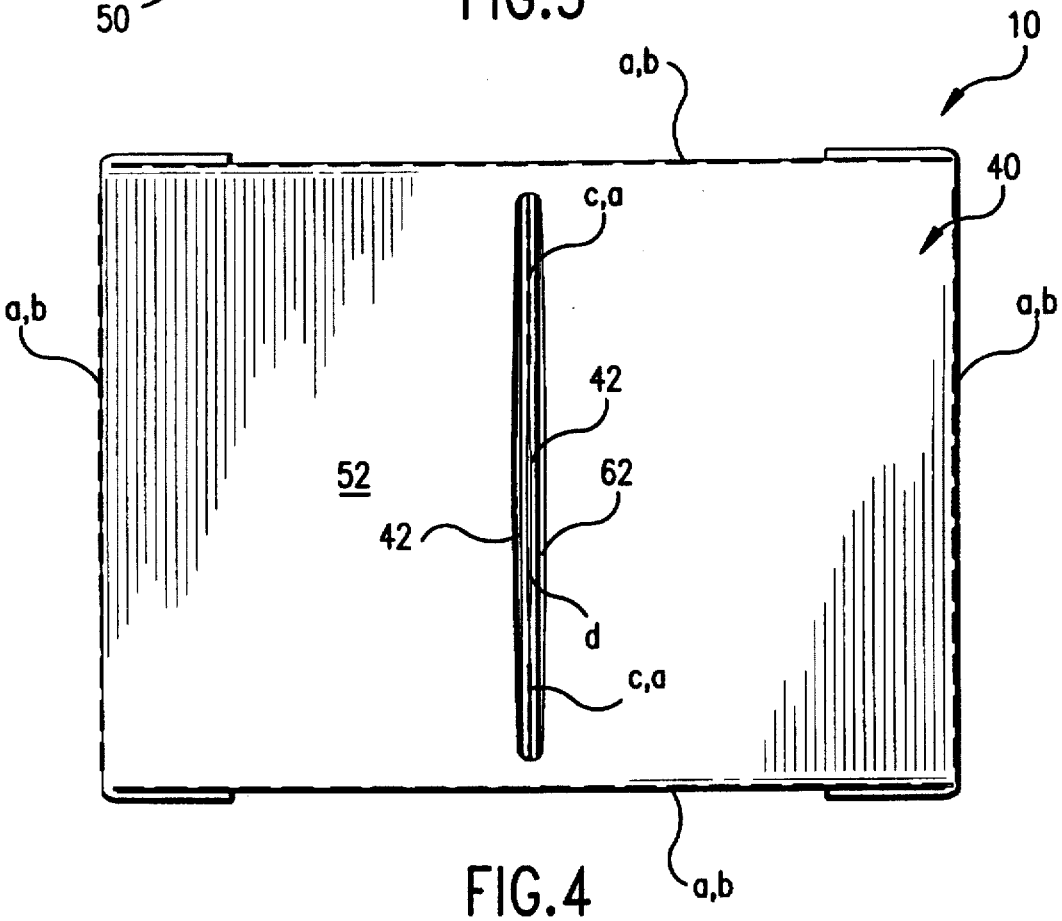
FIG. 4 is a top view of the dividable container shown in FIG. 1 with the cover installed thereon.

A top view of the cover member 40 positioned over the body member 30 is shown in FIG. 4. The cover member preferably includes at least one discontinuity 62, such as an opening 62, which serves as a guide for severing between the top edges 42 of the body member 30.

The opening or guide 62 is positioned preferably substantially over the top edges 42. The opening 62 may be elongated in shape, as shown, or may be any other shape which allows access to the top edges 42. The guide 62 is preferably configured and dimensioned to allow access to the top edges 42 while, at the same time, protecting the contents of the container 10 from accidental loss and/or pilferage. The opening 62 may extend across the entire surface of the top portion 52 or may extend only partially across the surface. If the opening 62 extends only partially, as shown in FIG. 4, the cover member 40 will have greater overall strength. Moreover, for the preferred embodiment, in order to divide the cover member 40, the top portion 52 must be cut or broken in the regions of the top portion 52 adjacent the ends of the elongated opening 62.

Figure 5:
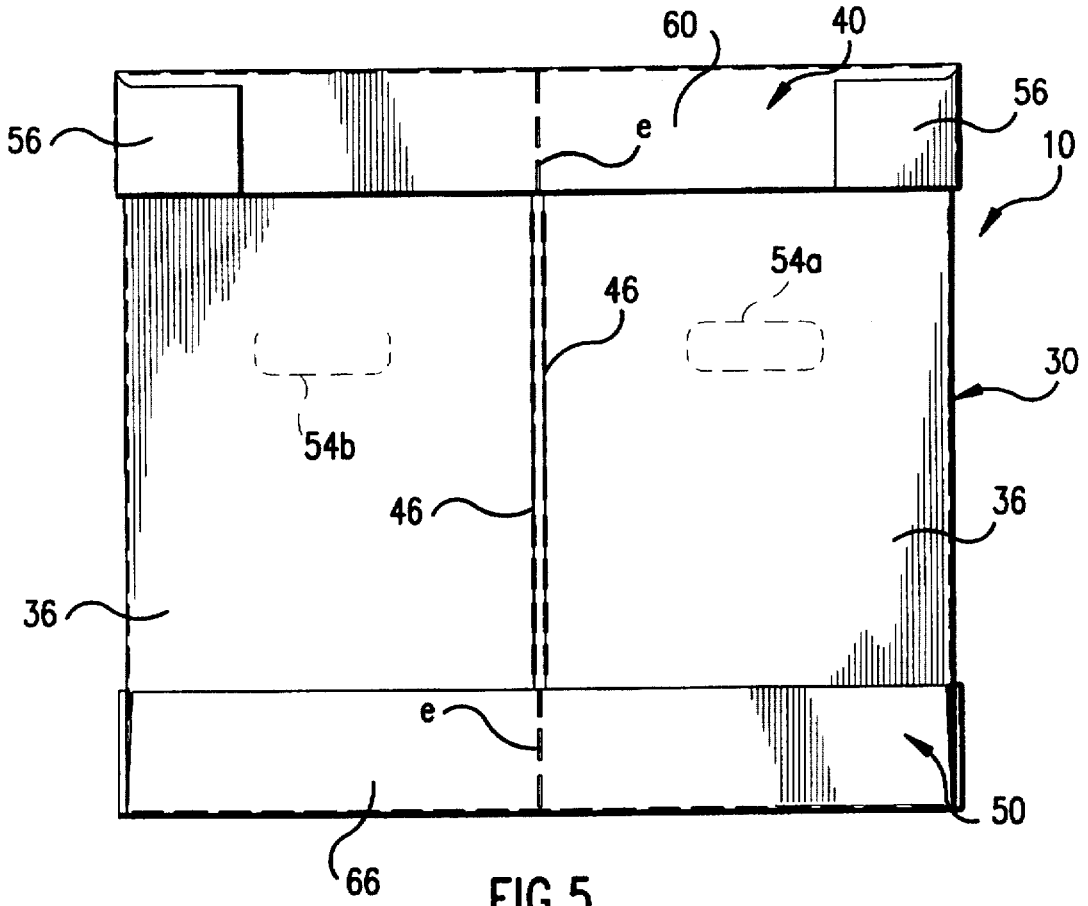
FIG. 5 is a front or back view of the container shown in FIG. 1.

The cover member 40, in order to be fully severed to allow for dividing of the container 10, also must be severed or broken along the flaps. As shown in FIG. 5, a line of perforations e is preferably defined on each inner flap 60 of the cover member 40. This line of perforations e is preferably in the vicinity of and adjacent to the side edges 46 of the interior walls 32 of the body member 30. The perforations e serve as a guide for cutting the inner flaps 60 and also minimize the amount of cutting required. Alternatively, the cover member 40 may be more amenable to tearing at the flaps 60 when perforations e are provided. The lines of perforations e preferably extend along the height of the inner flaps 60 and are preferably aligned with both the longitudinal axis X—X of the opening 62 (as shown in FIGS. 3 and 4) and with the plane formed between the interior walls 32. The joined portion between the top edges 42 falls within this plane.

For the preferred embodiment, as shown in FIGS. 4 and 5, in order to easily cut the flaps 60, a cutting edge may be positioned at the side edges 46 between the interior walls 32 of the body member 30 and may be brought upwardly to cut the cover member 40. Once a first flap 60 has been cut at the front of the container 10, the cutting edge may continue to be brought upwardly to cut through the top portion 52 and then between the top edges 42 of the body member 30. The cutting edge may then continue along its path to cut through the top portion 52 at the other end of the opening 62 and then through a second flap 60 of the cover member 40 at the back of the container 10. Once this cutting pattern has been followed, the container has been divided at the top opening 44 end. Alternatively v the cutting edge could be brought upwardly on both the front and back side of the container after being inserted between the side edges 46.

It should be readily evident that perforations e, while preferred on the flaps, are not required. If desired, the perforations may also extend from the flaps 60 onto the top portion 52 of the cover member 40 (not shown). Further, if desired, instead of including an opening 62 as a guide on the top portion 52, a line of perforations (not shown) may, alternatively, be provided. For this alternate embodiment, the perforations may preferably extend transversely across the entire surface of the top portion 52 of the cover member 40, positioned substantially over the top edges 42. In this alternative embodiment, similar to the previously discussed embodiments, the cover member 40 and top edges 42 may be severed simultaneously by inserting a cutting edge between the side edges 46 of the interior walls 32 and moving the cutting edge upwardly to cut the flap 60 at the front, then through the top portion 52 to sever both the top portion 52 and the top edges 42, then down to cut the opposite flap 60 at the back. This technique is advantageous because the cutting edge is at all times guided between the interior walls 32, avoiding the potential to enter into the compartments 20. Whether perforations are selected for the flaps will depend upon the specific shipping, handling, and overall material processing requirements.

As shown in the front or back view of the assembled container 10 in FIG. 5. Hand holes 54 may be optionally included on the body member 30 to assist in the transport of the containers 10. The hand holes 54*a* may be formed by punching out a portion of the first segment 36 of each side wall 34 for each compartment 20, as shown for the right compartment in FIG. 5. Alternatively, and more preferably, the hand hole 54*b* may instead be formed by cutting the bottom circumference of the hand hole 54 and then folding the cut out material inwardly or outwardly, as shown in the unfolded state on the left compartment of FIG. 5. The alternate embodiment, will provide greater strength and comfort to the user. Alternatively, other known types of hand holes may also be utilized, such as perforations which must be severed to form the hand hole, as shown in U.S. Pat. No. 4,793,494 to Gordon, Jr. or in U.S. Pat. No. 4,533,052 to Fruchey et al., the disclosures of both of which are incorporated herein by reference. Further, it should be noted that hand holes 54 may also be advantageously located in the second segment 38 of the side walls 34.

Further, while not shown in the figures, the cover member 40 may alternatively include a discontinuity or guide 62 in the form of a conventional tear strip, such as shown in U.S. Pat. No. 4,919,269 to Wright et al., the disclosure of which is incorporated herein by reference, or as shown in the Fruchey et al. patent, described above. The tear strip may preferably be positioned on the cover member 40 so as be positioned substantially over the top edges 42 and may extend to cover the flaps 58, 60 if so desired. Removal of the tear strip would preferably expose the top edges 42, and, alternatively would expose the contents of each compartment 20. An example of the latter is shown in the Gordon, Jr. or Fruchey et al. patents, described above, and could be utilized in addition to a tear strip positioned over the top edges 42 or in addition to an elongated opening 62 to extend across the top portion 52 in a location other than over the top edges 42.

Figure 6:
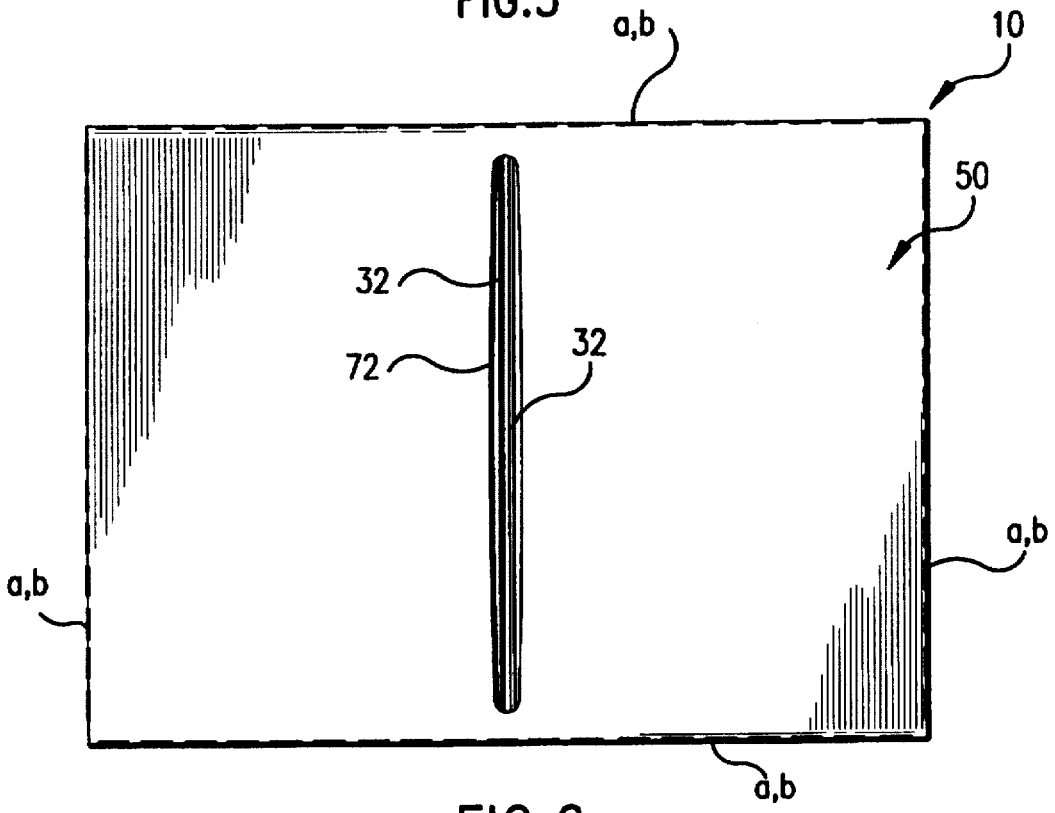
FIG. 6 is a bottom view of the container shown in FIG. 1.

Referring now to FIGS. 1, 2, and 6, the base member 50 is preferably a unitary member which forms the base or bottom of the container 10. Base member 50 includes a bottom portion 64 which is preferably substantially the same size as the bottom openings 45 of the compartments 20 of the body member 30. The bottom portion 64, as shown in the figures, is preferably substantially rectangular and is connected on each side to a flap 66. The flaps 66 are preferably integrally connected to the bottom portion 64 along fold or crease lines a and lines of perforations b. Alternatively, either the fold lines a or the perforation lines b may be provided on the flaps 66.

The base member 50 as preferably die cut from a single sheet of material. To assemble the base member 50, the flaps 66 are preferably folded at a substantially about 90° angle relative to the surface of the bottom portion 64. Each flap is preferably folded in a common direction so that a substantially rectangular box-type shape is formed. The base member 50 may then be positioned to close the bottom openings 45 of the compartments 20 of the body member 30. The flaps 66 become associated with or connected to the exterior of the side walls 34 of the body member 30 and are preferably fixed thereto. The flaps 66 ma y be affixed or secured to the side walls 34 of the body member 30 by means of an adhesive, by stapling, by taping, or by any other conventional connecting means. If adhesive is used, a hot melt adhesive is preferred and may be positioned in a continual line or pattern (not shown) along the length of each flap 66 for affixing each flap 66 to each side wall 34 of the body member 30. More preferably, the adhesive may instead be placed at several locations (not shown) along the length of each flap 66 in order to fix the flap 66 to the body member 30 while utilizing less adhesive. For the latter, adhesive is preferably positioned at each end 68 of each flap 66, as well as in a central region 70 of each flap 66. Preferably, the flaps 66 are fixedly associated with the body member 30 in order to close the bottom of the container for retaining items therein.

Flaps 66 have a height which is substantially shorter than the height of the body member 30. Flaps 66 preferably only cover a lower portion of the body member side walls 34 when the base member 50 is fixed over the bottom openings 45. The height of the flaps 66 will influence the overall stability of the container 10. Thus, if greater stability is desired, a higher flap 66 should be used. If greater stability is not required, in order to reduce the amount of material used in the construction of the container 10, it may be preferred to use a shorter flap 66. Further the amount and type of adhesive selected should be based upon the type of material utilized and the desired permanency of the base member 50 positioning relative to the body member 30.

A bottom view of the container 10 with base member 50 positioned over the bottom opening 45 of the body member 30 is shown in FIG. 6. The base member 50 preferably includes at least one discontinuity 72, such as an opening which exposes the interior walls 32 of the body member 30. Unlike the cover member 40! the interior walls 32 along the bottom opening 45 of the body member 30 do not need to be severed since they are not connected. Thus, a guide 72 is not required for the base member 50 for the purpose of serving between the edges of the body member. However, the discontinuity 72 is still desirable and preferred because it minimizes the amount of cutting necessary to divide the base member 50. Further, while an elongated opening 72 is preferred, the discontinuity 72 may take on any number of other forms, such as perforation lines or differently shaped openings.

Discontinuity 72 is preferably aligned with the plane formed between the interior walls 32 so that, upon cutting or breaking the connected portions of the base member 50, two separate containers may be formed. By providing the discontinuity 72 substantially over the interior walls 32 of the body member 30, after the body member 30 is separated, the two resulting containers have a neat appearance, without any edges or panels which protrude which could lead to tearing or other damage to the separated compartments 20.

In the preferred embodiment, the discontinuity is in the shape of an elongated opening 72 which extends substantially transversely across the surface of the bottom portion 64. The opening 72 preferably extends only partially across the surface, leaving part of the bottom portion 64 intact at either end of the elongated opening 72. This provides greater overall strength to the bottom portion 64. Flaps 66 may also include a discontinuity 74, such as a line of perforations e. The discontinuity on the flaps 66 is preferably aligned with the plane formed between the interior walls 32 of the body member 30.

In order to divide the base member 50, the base member 50 may be cut or broken in the same manner that the cover member 40 is separated. Referring to FIG. 5, a cutting edge is preferably positioned between the side edges 46 of the interior walls 32 of the container 10. The cutting edge is preferably moved downwardly to sever the first flap 66 in the front. If perforations e are provided on the flaps 66, the perforations e serve as an additional guide for the cutting edge. Further, the perforations e will make it easier to sever or break the base member 50 apart since less cutting is required. Then the container may be rotated to allow the cutting edge to sever the bottom portion 64 at the end of the elongated opening 72, as shown in FIG. 6. The other side of the base member may be severed in the same manner. This severing technique assists in preventing the cutting edge from entering the interior of the compartments 20, thereby avoiding any damage to the sub-containers in the compartments 20.

It should be noted that perforations may also be provided on the bottom portion 64 either at either end of the elongated opening 72 (not shown), or in place of the opening (not shown). If no opening 72 is present, then it is preferred that a line of perforations (not shown) extend transversely across the surface of the bottom portion 64. Alternatively, if preferred, no discontinuity 72 on either the bottom portion 64 or the flaps 66, is required as it is not essential to the invention.

In a preferred embodiment, the base member 50 is fixed to the body member 30 in order to assure that the bottom of the container 10 remains closed. If desired, a base member 50 similar to the cover member 40 may be utilized instead. If a base member 50 similar to the cover member 30 is utilized, the base member 50 is preferably fixed to the body member 30 by using a hot melt adhesive, or other conventional connecting means. It may be desirable to use an identical cover and base member in order to avoid additional tooling costs associated with creating the die for cutting the blanks. However, the base member 50 of the preferred embodiment is desirable because it is more simply constructed.

It should further be noted that the cover member 40 may be replaced by a member having the same construction as the base member 50. If a base member 50 is used to close both the top opening 44 and bottom opening 45 of the container 10, the base member is preferably fixedly associated with both the top and the bottom openings 44, 45. Since it is desirable to be able to remove the cover from the container 10, a lesser amount of adhesive and/or a weaker adhesive may be used to hold the cover member 40 in place, thereby making the cover member 40 more easily removable. Alternatively, as discussed above, perforations can be utilized to form tearing zones in the cover to make the top of the container 10 openable by tearing or cutting.

Figure 9:
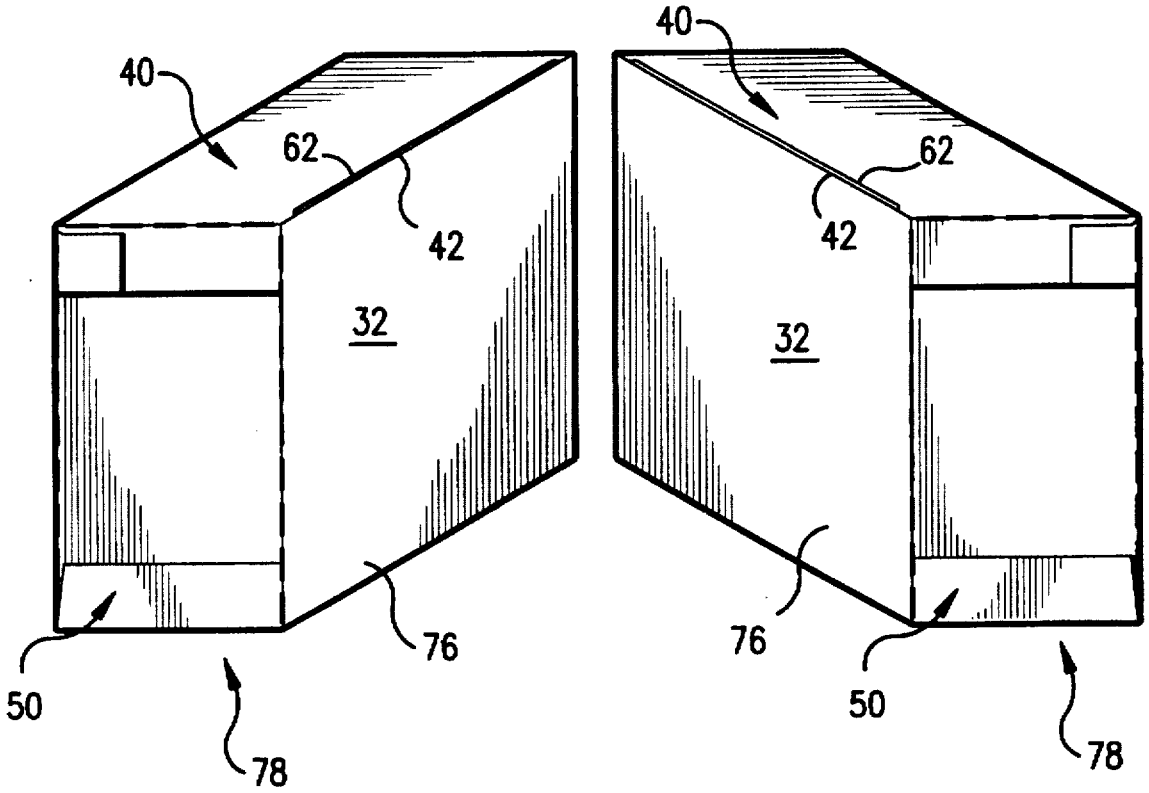
FIG. 9 is a perspective view of the container of FIG. 1 after it has been divided to form two separate containers.

Referring to FIG. 9, a preferred embodiment of the container 10 of the present invention is shown after being divided. As explained above, the container may be divided into two separate half-containers 78, each including one compartment 20 of the original container 10. The container is divided by severing between the top edges 42 of the interior walls 32, the cover member 40, and the base member 50 The inner facing surfaces 76 of the interior walls 32 form an outer wall for each separated container 78. As shown in FIG. 9, the finished divided containers 78 form two neatly appearing containers. Each resulting container 78 includes a base which is secured to the bottom and a cover which may be removed and replaced.

Figure 10:
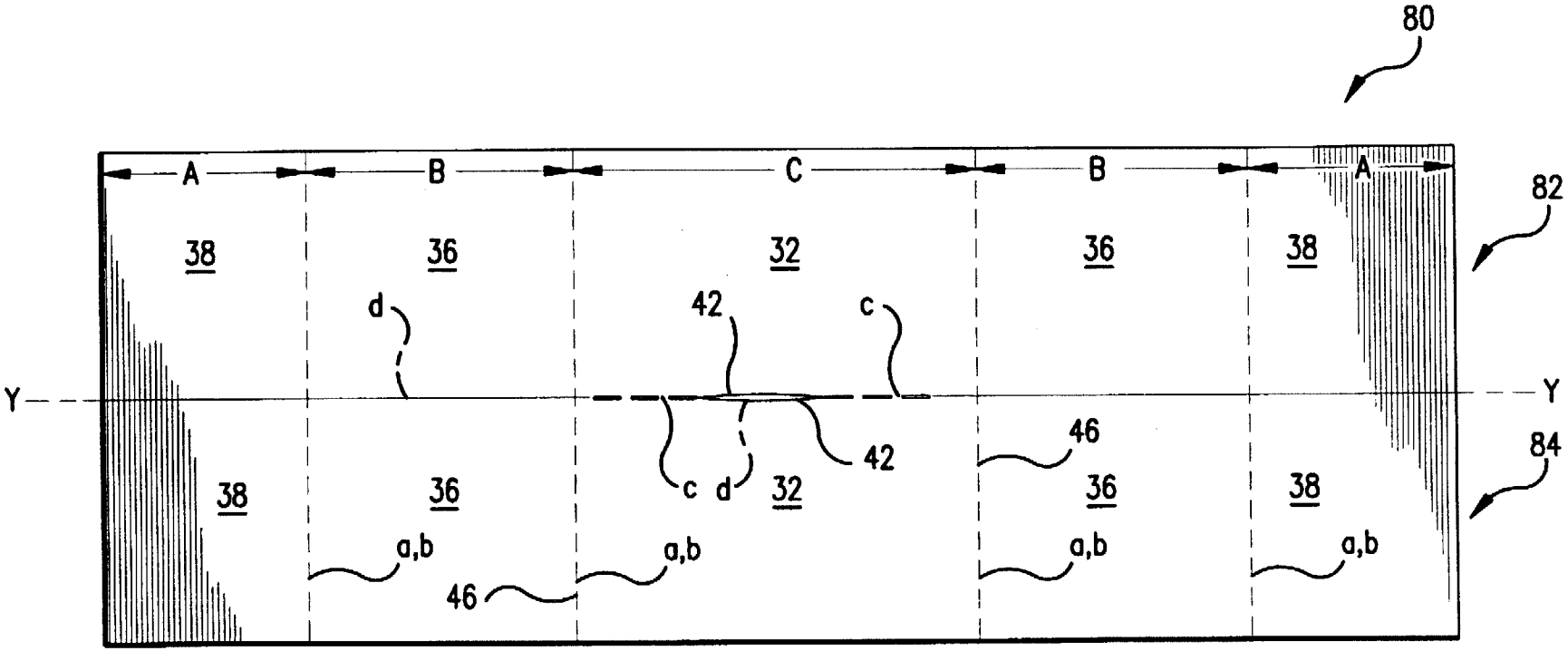
FIG. 10 is a plan view of a blank used to form the body member of the container shown in FIG. 1 after the blank material has been die cut and further processed to form fold lines and lines of perforations.
Figure 11:
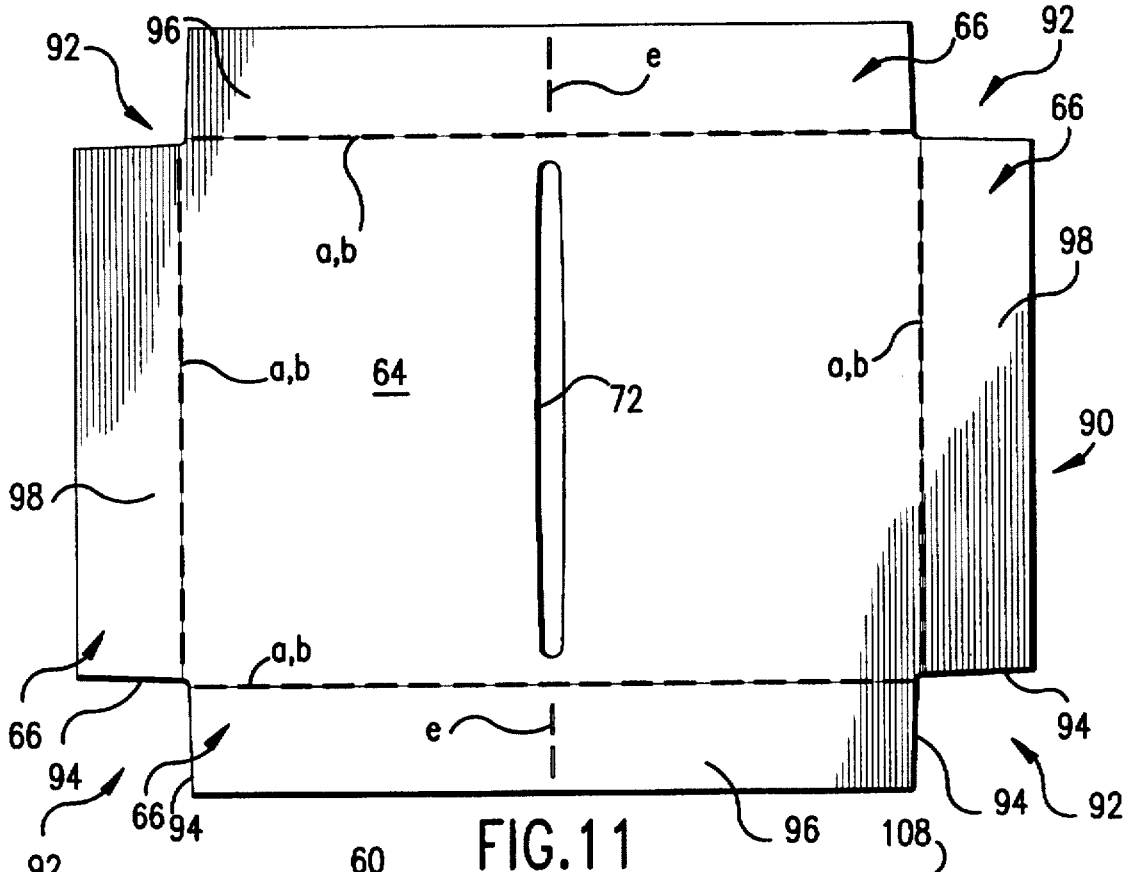
FIG. 11 is a plan view of a blank used to form the base member of the container shown in FIG. 1 after the blank material has been die cut and further processed to form fold lines and lines of perforations.

FIGS. 10–12 show the blanks used to form the preferred embodiment of the container 10 of the present invention as shown in FIGS. 1–9. The body member blank 80 is shown in FIG. 10, the base member blank 90 is shown in FIG. 11, and the cover member blank 100 is shown in FIG. 12. Each blank is preferably cut from a unitary sheet of material as described above. The blanks may be cut conventionally by cold die cutting, so as to be formable into the finished container, or by any other conventional means.

Each blank preferably includes a plurality of fold or crease lines a. The fold lines a may be formed after the blank is die cut either by rollers working on opposite sides of the blank or by scoring the material with a cutting edge. Fold lines a represent a weakened portion of the material, which provides a location for folding the blank. Any other known conventional techniques for creating fold lines may also be utilized. Alternatively, perforations b may be used in place of, or in addition to, the fold lines a. When perforations b are utilized, they are preferably arranged in a line. Lines of perforations b also represent a line of weakness in the blank material. A combination of fold lines a and lines of perforations b are particularly suited for strong materials, such as corrugated fiber board, because the combination makes the material more amenable to folding.

The blank 80 from which the body member 30 of the preferred embodiment is constructed is shown in FIG. 10 with the surface which will be on the inside of the compartments facing upwardly. The blank 80 is a substantially rectangularly shaped sheet of material having five different segments. The center segment C defines the two interior walls 32. The intermediate segments B are connected to the center segment C on one side and to the end segments A on the other side. The side edges 46 are defined between the B and C segments. Segments B are the first wall segments 36 and define the front and back walls of the container 10, as shown in FIG. 1. Segments A are the second wall segments 38 and define the sides of the container 10, as shown in FIG. 1. Segments B are preferably substantially the same size as each other. Segments A are also preferably the same size as each other, although this is not necessary to the invention. If segments A are similarly sized, the sides of the container 10 will have a uniform appearance, with the second wall segments 38 either meeting to abut each other, as shown in FIG. 7, or leaving a centrally defined gap 48 in the side of the container 10, as shown in FIG. 8. If desired, segments A may be differently sized, so that they abut in a location other than at the center of the side, or so that they form a gap which is not centrally located on the side.

Where it is desired that the second segments 30 abut each other to close the sides of the container 10, the length of segment C will equal the combined length of both segment A's. Thus, it is preferred that "Length C=Length A+Length A" in order to fully close the compartments 20 of the container 10.

In order to form a substantially rectangular container having centrally located interior walls 32, the body member blank 80 is preferably symmetrically arranged, with a first side 82 being a mirror image of a second side 84. The two sides 82, 84 are preferably separated along a longitudinal axis Y—Y. The blank 80 is preferably slit along portions of the longitudinal axis Y—Y to form two halves of the body member 30, which will ultimately form the two compartments 20. A slit d preferably extends from the outer edge of the blank 80 inwardly and longitudinally through segments A and B and partially extending into segment C. The first 82 and second 84 sides of the blank 80 are connected to each other along a portion of the longitudinal axis Y—Y within segment C. Preferably, segment C includes a combination of slit portions d and perforated portions c. The perforated portions c may also include fold lines, formed as discussed above. Lines of perforations b and/or fold lines a are preferably formed between each segment A, B, C.

The body member 30 may then be assembled by folding the body member blank 80 along the longitudinal axis Y—Y to define the top edges 42 of the interior walls 32. Segments C forms the interior walls 32, which are positioned in opposed relation. Segments B and A are then folded at substantially right angles inwardly at each side edge 46 of the body member 30 and then again between the A and B segments. Thus, when each segment 36, 38 is folded inwardly, the upwardly facing surfaces of the blank 80, as shown in FIG. 10 will be facing each other to define the inside of each individual compartments 20, with the first side 82 forming a first compartment 20 and the second side 84 forming a second compartment 20.

The body member blank 80 may also include cut out portions 86 representing the hand holes 54, as shown in FIG. 5. The hand holes 54 are preferably located in segments B, but may also be located in segments A.

It should be understood that the body member 30 may form any number of differently sized substantially rectangular shaped containers 10 having centrally located interior walls 32. As such, the body member 30 is a very efficient design which does not result in any wasted die cut material. If a container which has differently sized compartments is desired, the body member blank 80 will include a first side 82 which is substantially shorter than a second side 84 (not shown), where the first side 82 represents the smaller compartment and the second side 84 represents the larger compartment. Each side 82, 84 will preferably continue to have the same width in order to produce a container 10 having a uniform height.

The blank 90 from which the base member 50 of the preferred embodiment, as depicted in FIGS. 1–9, is constructed is shown in FIG. 11. The base member blank 90 is preferably a substantially rectangularly shaped unitary sheet of material having a central rectangular portion defining the bottom portion 64 and a plurality of outwardly extending flaps 66. A notch 92 is preferably cut out of each corner of the base member blank 90 to define the ends 94 of each flap 66. The notch 92 is preferably substantially square-shaped, although this shape is not critical to the invention. An elongated opening 72 is preferably defined to extend transversely and at least partially across the surface of the bottom portion 64.

There are two types of flaps provided on the base member blank 90. Inner flaps 96 are substantially the same length as the bottom portion 64 while outer flaps 98 are substantially the same width as the bottom portion 64. Both the inner flaps 96 and the outer flaps 98 are substantially the same height, although this is not critical to the invention.

Fold lines a preferably form a crisscross pattern on the base member blank 90 and extend both longitudinally and transversely on blank 90 to define the division between the flaps 66 and the bottom portion 64. Lines of perforations b may also be cut into the fold lines a between the bottom portion 64 and flaps 66. The lines of perforations b are designed to make it easier to fold the base member blank 90. A line of perforations e also preferably extends across each inner flap 96 in alignment with the longitudinal axis of the elongated opening 72 of the bottom portion 64. As discussed above for FIG. 6, the elongated opening 72 and flap perforations e will preferably be aligned with the plane formed between the interior walls 32 of the body member 30 when the base member 50 and body member 30 are assembled.

The blank 100 from which the cover member 40 of the preferred embodiment, as depicted in FIGS. 1–9, is constructed is shown in FIG. 12. The cover member blank 100 is preferably a substantially rectangularly shaped sheet of material having a central rectangular portion defining the top portion 52 and a plurality of outwardly extending flaps 58, 60. An elongated opening 62 is preferably defined to extend at least partially across the top portion 52. There are two types of flaps provided. Inner flaps 58 are substantially the same length as the top portion 52 while the outer flaps 58, which include tabs 56, are substantially the same length as the combination of the width of the top portion 52 and the height of the two inner flaps 60. Notches 108 are preferably cut out of the cover member blank 100 to define the separation between the inner flaps 60 and the tabs 56 of the outer flaps 58. While notch 108 is preferred, a slit would also suffice to separate the inner flaps 60 from the tabs 56.

Fold lines a preferably form a crisscross pattern on the cover member blank 100 and extend both longitudinally and transversely to define where the top portion 52 meets the flaps 58, 60 and where the tabs 56 meet the outer flaps 58. Lines of perforations b may also be cut into the fold lines a between the top portion 52 and flaps 58, 60. A line of perforations e also preferably extends across each inner flap 60 in substantial alignment with the longitudinal axis of the elongated opening 62 of the top portion 52. As discussed above for FIG. 4, the elongated opening 62 and flap perforations e are preferably aligned with the plane formed between the interior walls 32 and the top edges 42 of the body member 30 when the cover member 40 is assembled over the body member.

To assemble and fill the container 10 of the present invention, the following steps may be followed. The base member 50 is preferably positioned on a surface, such as a conveyor belt. Items to be stored in the container 10 are positioned on the upwardly facing bottom portion 52 of the base member 50. The body member blank 80 is then folded to form the body member 30 and inserted between and around the items positioned on the bottom portion 52 until the body member 30 comes to rest on the base member 50. Adhesive may then be applied at preferred locations on the upwardly facing surfaces of flaps 66 and flaps 66 are folded upwardly to be affixed to the side walls 34 of the container 10. Thereafter, the cover member 40 is placed over the top openings 44. Adhesive may be applied to the inner-facing surfaces of flaps 58, 60 and should be applied to the inner facing surfaces of tabs 56. Then flaps 58, 60 are folded downwardly to contact the side walls 34 of the container 10. Tabs 56 are then folded inwardly to be affixed to inner flaps 60.

If adhesive is applied to the inner facing surface of each flap 58, 60, the cover member 40 will be fixedly, but preferably removably, attached to the body member 30. Alternatively, to minimize the amount of adhesive used, adhesive may be applied to either the inner flaps 60 and tabs 56 only or to the outer flaps 58 and tabs 56 only. Also, it should be noted that other forms of connecting work equally well.

Another advantageous use of the container shown in the figures is as a display case. It is often desirable for retailers to stack boxes of products at end caps of aisles or at other locations within their stores. Advantageously, the cover member 40 ma y be removed from the top opening, flipped over, and positioned over and around the base member 50 so that the bottom of the container 10 seats in the cover member 40. Then the container 10 may be stacked one upon the other in an upright position with the base member 50 and cover member 40 acting in combination as the base for the container. This combination provides a sturdy base for supporting a plurality of containers 10 in a stack. Consumers then have access to the top openings 44 of each container 10 positioned at the top of the stack and may remove as many items as they like. Thus, the present invention provides a dividable container which is well suited for shipping, handling, and display.

FIG. 13 shows an alternative embodiment of the present invention which is equally preferred to the embodiment shown in FIGS. 1–12, but which is oriented differently than the container shown in FIGS. 1–12. The embodiment shown in FIG. 13 is useful as a six count container which may be divided into two three count containers. As shown, the overall configuration of the container is substantially the same as the prior embodiment except that the body member 30 is oriented so that the interior walls 32 extend along the length of the container, rather than across the width. Thus, the elongated openings 62, 72 in the cover member 40 and base member 50 extend longitudinally rather than transversely. Further, the second segments 38 of the body member 30, instead of forming the sides of the container now form the front and back of the container. As shown, the second segments 38 may be of different widths so that they abut, but not in a central location.

FIG. 14 shows another alternative embodiment of the container 110 of the present invention where four separate compartments 120 are included. For this embodiments two separate body members 30 are utilized so that two joined portions between four top edges 42 must be severed in order to separate the compartments of each body member 30. Two body members 30 are placed in opposed side-by-side relation to define four side-by-side compartments 120. The cover member 130 and base member 140 will be long enough to accommodate the length of the two body members 30. Further, the cover member 130 and base member 140 include a total of three elongated openings or discontinuities 142 which extend transversely over the surfaces of the members 130, 140 over the top edges 42 as well as between the second segment walls 38 where the two body members 30 meet in a centrally located position. The cover and base members are severed in the same manner as described above for FIGS. 1–12 to form anywhere from two to four separate containers. With this embodiment, it is preferred that the flaps of the base and cover members be affixed to the side walls 34, such as by an adhesive attachment, of the body members so that when the compartments are divided, the cover 130 and base 140 members will remain attached to each separated container. As discussed above, perforations formed in the cover and base member may be utilized to remove the base and cover members from the containers.

It should be evident that any number of body members may be utilized in side-by-side or other relation to form any number of additional compartments. Further it is evident that, while a rectangular container was shown in the drawings, it is understood that the container may take on any number of other shapes, such as square, trapezoidal, symmetric or non-symmetric. Each shape can be provided by folding and configuring each member of the container to meet the specific shape requirements. Further, the container shown has a first and second compartment, each of which is substantially the same size with a centrally located interior wall. If desired, the two compartments may be of different sizes. For example, the first compartment may be sized to fit six bottles while the second compartment is sized to fit twelve bottles—adding versatility to the size of the package available to the ultimate purchaser.

It should be noted that, while various embodiments of the present invention were depicted above, it is understood that the various features of the invention can be used singly or in any combination thereof. Therefore, this invention is not to be limited to only the specifically preferred embodiments depicted herein.

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. A dividable container which comprises:

a one piece body member defining first and second compartments having top and bottom openings with each compartment including an interior wall having a top edge and two side edges, and a side wall extending from each side edge of the interior wall, each side wall having first and second wall segments which are joined together and folded to form portions of two different sides of the container, with the top edges of the interior walls being at least partially connected;

a cover member operatively associated with the first and second wall segments of the body member for enclosing the top openings of the compartments; and a base member operatively associated with the first and second wall segments of the body member for enclosing the bottom openings of the compartments, wherein the cover member, base member, and top edges of the interior walls can be severed along a plane located between the interior walls to form segmented first and second compartments.

2. The dividable container of claim 1, wherein said cover member includes at least one cover member discontinuity aligned with said plane.

3. The dividable container of claim 2, wherein said cover member includes a top portion and a plurality of flaps configured and dimensioned to contact the first and second wall segments of the body member, and the cover member discontinuity is an opening.

4. The dividable container of claim 3, wherein the opening in the cover member is elongated and extends at least partly over the top edges of the interior walls.

5. The dividable container of claim 2, wherein the cover member discontinuity includes a plurality of perforations.

6. The dividable container of claim 5, wherein said perforations on the cover member are arranged in at least one line.

7. The dividable container of claim 5, wherein the perforations on the cover member are arranged to allow for removal of at least part of the a top portion of the cover member.

8. The dividable container of claim 1, wherein said base member includes at least one base member discontinuity aligned with said plane.

9. The dividable container of claim 2, wherein the base member includes a bottom portion and a plurality of flaps, said base member flaps being attached to the first and second wall segments of the body member for retaining items in the compartments, and the base member discontinuity is an opening.

10. The dividable container of claim 3, wherein the opening of the base member is elongated and extends at least partly over the body member to expose the interior walls.

11. The dividable container of claim 2, wherein the base member discontinuity includes a plurality of perforations.

12. The dividable container of claim 5, wherein said perforations on the base member are arranged in at least one line.

13. The dividable container of claim 1, wherein the first and second compartments are arranged in abutting relation and the second segments extending from each interior wall abut each other to close each compartment.

14. The dividable container of claim 1, wherein the second segments extending from each interior wall are non-abutting relative to each other to provide a window for each compartment.

15. The dividable container of claim 9, wherein the flaps on the bottom member do not overlap each other.

16. The dividable container of claim 3, wherein at least one of the flaps on the cover member overlaps another flap on the cover member.

17. The dividable container of claim 1, wherein the connected portions of the top edges include at least one perforation.

18. The dividable container of claim 1, further comprising perforations or crease lines between the interior walls, the first wall segments, and the second wall segments to facilitate folding.

19. The dividable container of claim 1, wherein the base member is adhesively attached to the wall segments.

20. The dividable container of claim 19, wherein the cover member is adhesively attached to the wall segments.

21. The dividable container of claim 20, wherein the cover member is removable from the body member.

22. The dividable container of claim 1, wherein the interior walls are substantially centrally located in the container to define substantially equally sized compartments.

23. The dividable container of claim 1, wherein a plurality of body members are provided.

* * * * *